United States Patent [19]

Caves

[11] 4,441,252

[45] Apr. 10, 1984

[54] HAIR TRIMMING DEVICES

[76] Inventor: Thomas J. Caves, 223 Island Way, Clearwater, Fla. 33515

[21] Appl. No.: 390,278

[22] Filed: Jun. 21, 1982

[51] Int. Cl.[3] ..... B26B 21/12

[52] U.S. Cl. ..... 30/30; 30/53

[58] Field of Search ..... 30/30, 31, 336, 338, 30/53, 54, 55

[56] References Cited

U.S. PATENT DOCUMENTS

| | | | |
|---|---|---|---|
| 1,083,026 | 12/1913 | Ohlsson | 30/53 |
| 2,746,144 | 5/1956 | Spanel | 30/31 |
| 2,857,668 | 10/1958 | Galbraith | 30/54 |
| 3,165,831 | 1/1965 | Carroll | 30/30 |
| 3,183,589 | 5/1965 | Szabo | 30/30 |

*Primary Examiner*—Jimmy C. Peters

*Attorney, Agent, or Firm*—Ronald E. Smith

[57] ABSTRACT

A hair trimming device. A conventional razor blade means is held in sandwiched relation between a base plate member and a base plate capping member.Such members are adapted to mate with one another for alignment purposes and are yoked together to form a blade-sandwiching unit by a fork formed in the distal end of an elongate handle means with which the device is manipulated. The arms of the forked yoking means are resilient and diverge when the base plate member and the capping member unit are slideably inserted therebetween, due to a ridge means formed on the respective outer surfaces of such base plate and capping members, and such arms converge when the ridge means enters into juxtaposition with complementally formed recess means formed on the respective inner surfaces of the resilient arms.

3 Claims, 4 Drawing Figures

HAIR TRIMMING DEVICES

BACKGROUND OF THE INVENTION

1. Field of the Invention

This invention relates, generally, to non-motorized hair trimming devices and more specifically to a hair trimming device characterized by an integrally formed combination handle and yoking means that provides a means for retaining a conventional razor blade in sandwiched relation between a pair of complementally formed, releasably secured members that form a housing for such blade when the device is in use.

2. Description of the Prior Art

There are several non-motorized hair trimming devices that are known. Typically, however, blade changing requires the removal of a bolt and nut assembly so that the parts of the device that house the blade can be separated.

There is a need for a device that requires no nuts and bolts to hold it together. The earlier devices are also clumsy to handle, so there is a need for an easily handled hair trimming device as well.

The most similar earlier device to the invention to be disclosed hereinafter is shown in the inventor's co-pending disclosure filed June 1, 1981, bearing Ser. No. 6/268,836. Although the device disclosed therein provides many advantages over earlier devices, such device has some structural complexity which could result in higher manufacturing costs than the invention to be disclosed herein. Accordingly, there is a need for a hair trimming device of the utmost structural simplicity that is very economical to manufacture and that is elegant in its concept.

SUMMARY OF THE INVENTION

The longstanding but heretofore unfulfilled need for an elegant non-motorized hair trimming device having a structure of irreducible simplicity is now fulfilled in the form of a device having a bifurcated blade housing that is held together as a unit by a yoking means that is characterized by a pair of resilient arm members. The resiliency of the arms allows the blade housing unit to be removed and reinserted therefrom and thereinto, respectively, in the absence of nuts, bolts, or other mechanical securing means.

The yoking means is integrally formed with an elongate handle member, said yoking means provided in the form of a pair of substantially parallel, transversely spaced arm members, each of which has a recess formed therein on its inward facing surface. The blade housing means is provided in the form of a base plate member and a base plate capping member, both of which are generally flat and of rectangular configuration. The base plate and its capping means are provided with projecting ridges on their respective outward facing surfaces that engage the associated recesses formed in the inward facing surfaces of the yoking means arm members when such blade housing means is slideably disposed therebetween.

It is therefore seen that an important object of this invention is to provide a non-motorized hair trimming device that is easy to assemble and disassemble so that blade changing can be accomplished quickly and easily.

Another important object is to provide the needed device in an easily manufactured, and thus easily affordable, form.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DESCRIPTION OF THE PREFERRED EMBODIMENT OF THE INVENTION

Figure 1:
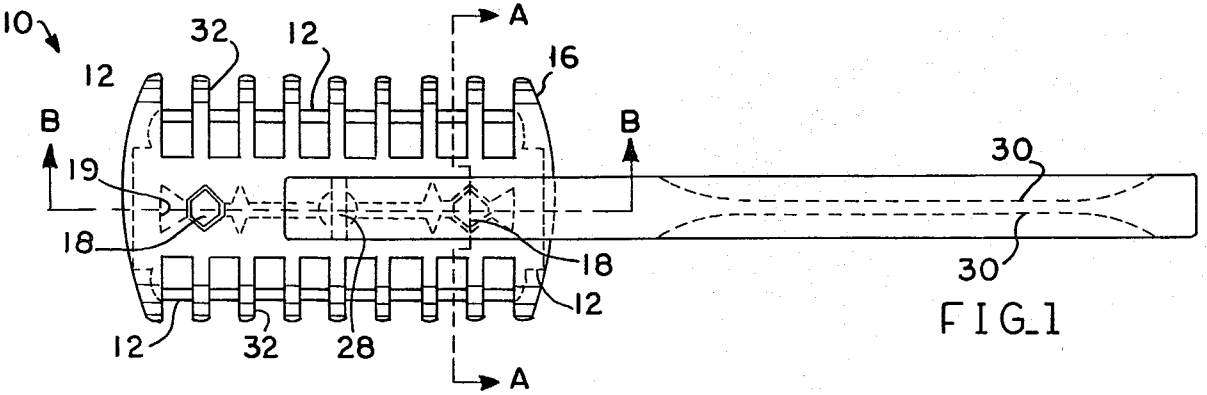
FIG. 1 is a top plan view of the preferred embodiment of the invention.

Referring now to FIG. 1, there it will be seen that the preferred embodiment of the invention is designated 10 as a whole.

Figure 4:
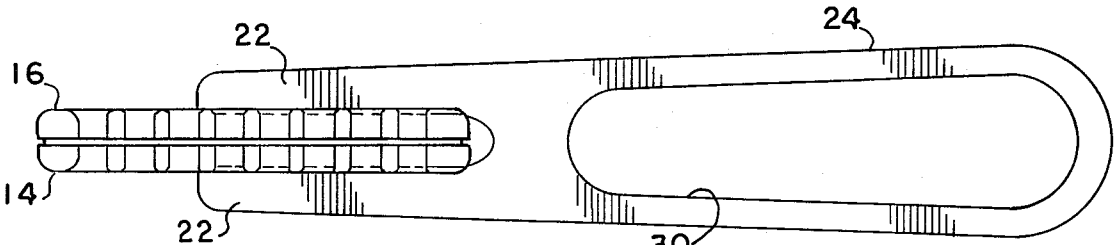
FIG. 4 is a side elevational view of the preferred embodiment of the invention.
Figure 3:
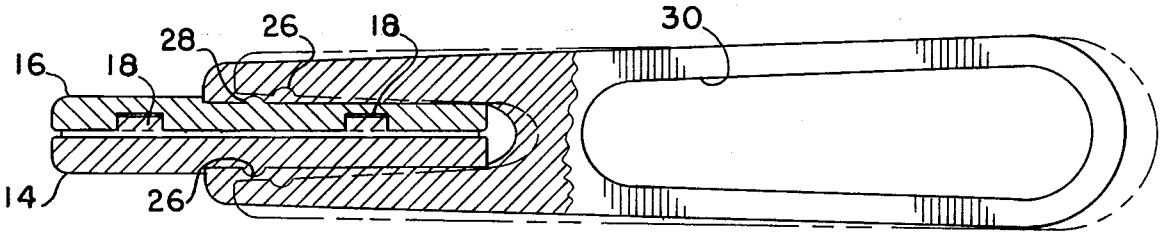
FIG. 3 is a longitudinal sectional view taken along line B—B of FIG. 1.
Figure 2:
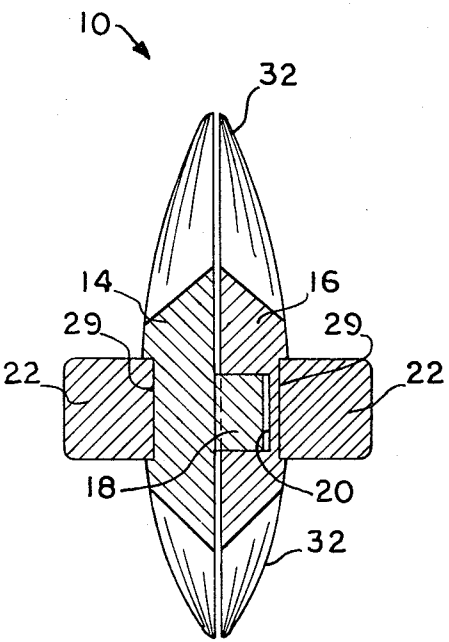
FIG. 2 is a transverse sectional view taken along line A—A of FIG. 1.

A conventional razor blade means is shown in such FIG. and is indicated by the reference numeral 12. The blade 12 is disposed in sandwiched relation to a base plate member 14 and a base plate capping member 16 (FIGS. 2–4). As is clear from the drawings, the base plate 14 and the capping member 16 are of substantially identical configuration, the difference lying in the provision of upstanding, longitudinally spaced peg members 18 formed in the base plate 14. The conventional blade 12 is manufactured with a symmetrical, longitudinally extending slot 19 formed therein, having a curvilinear perimeter as shown in FIG. 1. The curvilinear perimeter defines a pair of longitudinally spaced openings that synergistically define passageways through which the pegs 18 extend. The diameter of the pegs 18 is made just slightly less than the diameter of such openings so that the pegs 18 will extend therethrough and prevent lateral movement of the blade 12 when so extended. Thus, the pegs 18 serve to locate and align the blade 12 as well as to hold such blade 12 in position.

With the blade 12 in position on the base plate member 14, the base plate capping member 16 is snapped onto the pegs 18 by aligning such pegs with cooperatively positioned peg receiving apertures 20 formed in the capping member 18, each aperture 20 releasably receiving a different peg 18. This easy assembly provides a housing for the blade 12.

In FIGS. 1, 3 and 4 it will be seen that the housing unit formed of members 14, 16 is slideably retained between arms 22, 22 that are integrally formed with elongate handle member 24. The arms 22, 22 are formed of a resilient material and are provided with a recess individual to each arm, such recesses being designated 26 in FIG. 3. The recesses 26, 26 are aligned normal to the longitudinal axis of symmetry of the handle and snap fittingly mate with complementally formed and cooperatively positioned projecting ridge members 28 formed in the respective outermost surfaces of the housing members 14, 16. The ridges 28, 28 are formed in a square in section slot means 29, 29 (FIG. 2), such slot means provided to slidingly receive the arms 22, 22. As shown in FIG. 3, the arms 22 transiently diverge responsive to sliding introduction of the housing members 14, 16 into the space defined by the arms 22, 22-such divergence shown in phantom lines-and converge when ridges 28, 28 align with recesses 26, 26, thereby snapping the blade housing unit 14, 16 into place.

As shown in FIG. 1, the housing formed by members 14, 16 can be easily removed when the handle 24 is being gripped by simply pushing such housing to the left as the unit 10 is depicted in such Figure with the thumb and forefinger. The housing is also easily removed by simply grasping the housing where it extends from the yoking means defined by the arms 22, 22, and retracting the same. During the retraction process, the arms 22, 22 will of course transiently diverge due to the misalignment of ridges 28 and recesses 26, just as in the introduction process.

As shown in FIGS. 1, 3 and 4, an oval shaped material saving depression 30 is formed in the handle 24. The depression 30 also aids in the gripping of the device 10.

As is clearly shown in FIG. 1, and as is clear from an inspection of FIG. 2 as well, a plurality of transversely aligned cut away portions 32 are formed in the base plate and capping members 14, 16 to expose the cutting edges of the blade 12. Preferably, the cut away portions on one side of the housing are deeper than the opposing cut away portions so that hair can be trimmed to different lengths depending on the side of the device chosen.

The right angle relation between the blade housing 14, 16 and the handle 24 provides a device that is very easy to handle. The device can be made of high impact plastic in any color, and thus can be made very attractive to consumers at an affordable price. Blade changing is quick and easy, and the device works well.

It will thus be seen that the objects set forth above, and those made apparent by the preceding description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

That which is claimed is:

1. A hair trimming device, comprising, a double-edged razor blade means, a base plate member of rectangular configuration having a length corresponding to the length of said razor blade means, said base plate member having an outer surface and an inner surface, a pair of longitudinally spaced, longitudinally aligned upstanding peg members disposed coincident with the longitudinal axis of symmetry of said base plate member, on the inner surface thereof, said peg members in registration with associated openings formed astride the longitudinal axis of symmetry of said razor blade means when said razor blade means is disposed atop said inner surface of said base plate means, a base plate capping member corresponding in configuration and dimension to said base plate member, said base plate capping member having an inner surface and an outer surface, said base plate capping member having peg-receiving recesses formed in said inner surface, said recesses disposed in registration with said peg members to releasably receive the same when said base plate member and said base plate capping member are disposed in sandwiching relation to said razor blade means, an elongate handle member, said handle member terminating in a yoke means, said yoke means including a pair of transversely spaced, substantially parallel arm members, a notch-like recess formed in each of said arm members in transversely spaced relation to one another for releasably retaining said base plate member and said base plate capping member in abutting relation to one another when the device is in use, a longitudinally aligned slot means formed on the respective outer surfaces of said base plate member and said base plate capping member, said slot means adapted to slidingly receive opposed, inwardly facing surfaces of said arm members, an outwardly projecting ridge-like means formed in the outwardly facing respective surfaces of said slot means to engage said notch-like recess of said arm members, a plurality of transversely aligned, longitudinally spaced cut away portions formed in the respective transverse edges of said base plate and base plate capping members to expose the transverse edges of said razor blade means to the hair to be cut, the depths of the transversely opposite cut away portions being different so that a first edge of said razor blade means is employed to cut hair at a first length, and so that a second edge of said razor blade means is employed to cut hair at a second length.

2. The device of claim 1, wherein the respective lengths of said arm members and of said slot means are substantially equal, and wherein said lengths are less than the length of said base plate and base plate capping members so that the excess length of the latter mentioned members is easily grasped by a human hand so that such base plate and base plate capping members can be removed or reinserted from and into, respectively, the grip of said yoke means when desired.

3. The device of claim 2, wherein said base plate and base plate capping members are disposed in a plane orthogonal to the plane of said handle means when engaged by said yoke means.

* * * * *